US011450503B2

(12) United States Patent
Pan et al.

(10) Patent No.: US 11,450,503 B2
(45) Date of Patent: Sep. 20, 2022

(54) X-RAY TUBE AND X-RAY IMAGING APPARATUS

(71) Applicant: Siemens Healthcare GmbH, Erlangen (DE)

(72) Inventors: Jing Ping Pan, Wuxi (CN); Ru Bai Cheng, Wuxi (CN)

(73) Assignee: Siemens Healthcare GmbH, Erlangen (DE)

( * ) Notice: Subject to any disclaimer, the term of this patent is extended or adjusted under 35 U.S.C. 154(b) by 0 days.

(21) Appl. No.: 17/205,334

(22) Filed: Mar. 18, 2021

(65) Prior Publication Data

US 2021/0296073 A1 Sep. 23, 2021

(30) Foreign Application Priority Data

Mar. 20, 2020 (CN) ..... 202020372532.9

(51) Int. Cl.
*H01J 35/06* (2006.01)
*H01J 35/16* (2006.01)

(52) U.S. Cl.
CPC ..... *H01J 35/06* (2013.01); *H01J 35/16* (2013.01); *H01J 35/165* (2013.01)

(58) Field of Classification Search
CPC ..... H01J 35/06; H01J 35/16; H01J 35/165
See application file for complete search history.

(56) References Cited

U.S. PATENT DOCUMENTS 2,213,112 A * 8/1940 Timmons ..... H01J 35/025 315/98
2,239,416 A * 4/1941 Ehrenberg ..... H01J 35/14 313/38
6,188,747 B1 * 2/2001 Geus ..... H01J 35/112 378/124
2013/0121473 A1 * 5/2013 Yamazaki ..... H01J 35/16 378/121
2013/0259197 A1 * 10/2013 Kuribayashi ..... H01J 1/88 378/64

* cited by examiner

*Primary Examiner* — Chih-Cheng Kao
(74) *Attorney, Agent, or Firm* — Banner & Witcoff Ltd.

(57) ABSTRACT

An X-ray tube and an X-ray imaging device are disclosed. The X-ray tube comprises: a glass envelope; a cathode assembly, accommodated inside the glass envelope; and a core column structure, connected to the glass envelope and the cathode assembly, such that the cathode assembly is sealed inside the glass envelope. The core column structure comprises: a metal flat plate, wherein the cathode assembly is fixed to the metal flat plate; and a sealing bead, wherein the sealing bead is arranged in the metal flat plate, and an electrically conductive support rod connected to the cathode assembly passes through two ends of the sealing bead. The X-ray tube enables generated heat to be rapidly transferred to a cooling medium via thermally conductive metal to improve heat dissipation efficiency.

16 Claims, 2 Drawing Sheets

X-RAY TUBE AND X-RAY IMAGING APPARATUS

CROSS-REFERENCE TO RELATED APPLICATIONS

The present application claims the benefit of the filing date of China patent application no. CN 202020372532.9, filed on Mar. 20, 2020, the contents of which are incorporated herein by reference in their entirety.

TECHNICAL FIELD

The disclosure relates to the field of medical equipment and, in particular, to an X-ray tube and an X-ray imaging device.

BACKGROUND

Conventionally, a cathode structure of an X-ray tube generally consists of a glass core column, a cathode head, and a cathode cover. The glass core column generally has a number of metal support rods for supporting the cathode head and cathode cover and for conducting electricity for a cathode filament. These metal support rods extend to the outside through a glass envelope. Of the entire cathode, only the support rods are in contact with an external cooling medium, with all other regions being sealed in a vacuum cavity by the glass envelope. Thus, most of the heat generated by the filament is conducted only by thermal radiation. As a result, the cathode temperature is very high (generally capable of reaching more than 200 degrees Celsius). Such a high X-ray tube cathode temperature will have an adverse effect on the stable operation of the X-ray tube (especially in scenarios where continuous operation for a long period of time is required), and will reduce the service life of the X-ray tube. Until now, a one-piece cathode design with glass bead insulation has been used in X-ray tubes that operate continuously for long periods of time. This design can lower the cathode temperature to a certain extent, but the overall structure is complex, the process is complicated, the manufacturing requirements are exacting, the glass bead is at risk of bursting, and the product has a certain gas leakage ratio.

SUMMARY

The present utility model provides an X-ray tube and an X-ray imaging device. In particular, the X-ray tube is a fixed-anode X-ray tube. The X-ray tube according to the present disclosure implements a novel type of core column structure in place of the conventional glass core column structure, and thus expands the contact area between thermally conductive metal and a cooling medium, thereby enabling the rapid transfer of heat generated by a cathode head to the cooling medium via the thermally conductive metal.

One aspect of the present disclosure provides an X-ray tube, wherein the X-ray tube comprises: a glass envelope; a cathode assembly accommodated inside the glass envelope; and a core column structure connected to the glass envelope and the cathode assembly, such that the cathode assembly is sealed inside the glass envelope. The core column structure comprises: a metal flat plate, wherein the cathode assembly is fixed to the metal flat plate; and a sealing bead, wherein the sealing bead is arranged in the metal flat plate, and an electrically conductive support rod connected to the cathode assembly passes through two ends of the sealing bead. The X-ray tube according to the present disclosure implements a different core column structure from that conventional X-ray tubes. The embodiments described herein provide an X-ray tube having a core column structure that can effectively transfer heat generated by a cathode filament to the cooling medium directly by heat conduction, and at the same time shares certain characteristics with the conventional glass core column structures, specifically in that the X-ray tube production process is simple and the product pass rate is high.

According to an exemplary embodiment of the present disclosure, the X-ray tube further comprises: a metal ring, wherein the metal flat plate is connected in a sealed manner to the glass envelope by means of the metal ring. The core column structure according to the present disclosure has the metal ring for sealed connection to the glass envelope; this enables the core column structure to be joined to the glass envelope to advantageously achieve good sealing of the cathode assembly and an anode assembly as well as a good heat dissipation effect.

According to an exemplary embodiment of the present disclosure, the metal ring is melt-connected to the glass envelope. This simplifies a manufacturing process for connecting the core column structure to the glass envelope in a sealed manner.

According to an exemplary embodiment of the present disclosure, the metal flat plate comprises a plate body part and a tube body part extending from the plate body part in an axial direction; the metal ring has an end wall connected in a sheathing manner to the tube body part, and is connected in a sealed manner to the metal flat plate by Tungsten inert gas (TIG) welding of the end wall to the tube body part. The connection of the metal flat plate to the metal ring further enlarges a heat dissipation area for contact with the cooling medium, thus increasing the heat dissipation efficiency.

According to an exemplary embodiment of the present disclosure, the cathode assembly is connected in a sheathing manner to the metal flat plate by screw-thread connection or welding. The use of a sleeve-type mounting method to establish contact between the cathode assembly and cooling metal does not affect an existing manner of fitting of a cathode structure and filament, and thus there is no need to adjust an original filament fitting operation.

According to an exemplary embodiment of the present disclosure, the metal ring and/or the metal flat plate is made of nickel-cobalt ferrous alloy (e.g. a Kovar alloy). Compared with a one-piece cathode structure, the metal flat plate of the present disclosure has a larger heat dissipation area, facilitating the rapid transfer of generated heat to the cooling medium.

According to an exemplary embodiment of the present disclosure, the sealing bead is made of ceramic or glass. This can lower the cost of manufacturing the X-ray tube, and such a material also has good insulating properties.

According to an exemplary embodiment of the present disclosure, the core column structure further comprises: a gas discharge tube, wherein the gas discharge tube is arranged in the metal flat plate and extends out from the metal flat plate. The gas discharge tube provides another heat conduction path to the cooling medium, thus further improving heat dissipation from the cathode assembly.

According to an exemplary embodiment of the present disclosure, the discharge tube is made of copper or glass. When the gas discharge tube formed on the core column structure is likewise immersed in the cooling medium, the area of contact with the cooling medium is increased, thus improving the heat dissipation efficiency.

Another aspect of the present utility model provides an X-ray imaging device, wherein the X-ray imaging device comprises the X-ray tube as described above.

BRIEF DESCRIPTION OF THE DRAWINGS/FIGURES

The accompanying drawings form a part of this disclosure, and are intended to be of assistance in gaining further understanding of the present disclosure. These drawings illustrate embodiments of the present disclosure, and together with the disclosure are intended to explain the principles of the embodiments of the present disclosure. In the drawings, identical components are indicated using identical labels. The following are shown in the drawings.

Key to labels used in the drawings.

10: glass envelope;
20: cathode assembly;
30: core column structure;
31: metal flat plate;
32: sealing bead;
100: X-ray tube;
321: electrically conductive support rod;
33: metal ring;
311: plate body part;
312: tube body part;
313: gas discharge hole sidewall;
331: end wall;
34: gas discharge tube.

DETAILED DESCRIPTION

To give those skilled in the art a better understanding of the solution of the present disclosure, the technical solution in the embodiments will be described below clearly and completely in combination with the drawings in the embodiments. Obviously, the embodiments described may represent some but not all of the embodiments of the present disclosure. Other solutions may be obtained by those skilled in the art on the basis of the embodiments of the present disclosure without excessive or undue experimentation and thus fall within the scope of protection of the present disclosure.

It is further explained that the terms "comprise" and "have" and any variants thereof in the description and claims of the present disclosure and the abovementioned drawings are intended to cover non-exclusive inclusion. For example, products or devices comprising a series of units are not necessarily limited to those units which are clearly listed, but may comprise other units which are not listed or are intrinsic to these products or devices.

Figure 1:
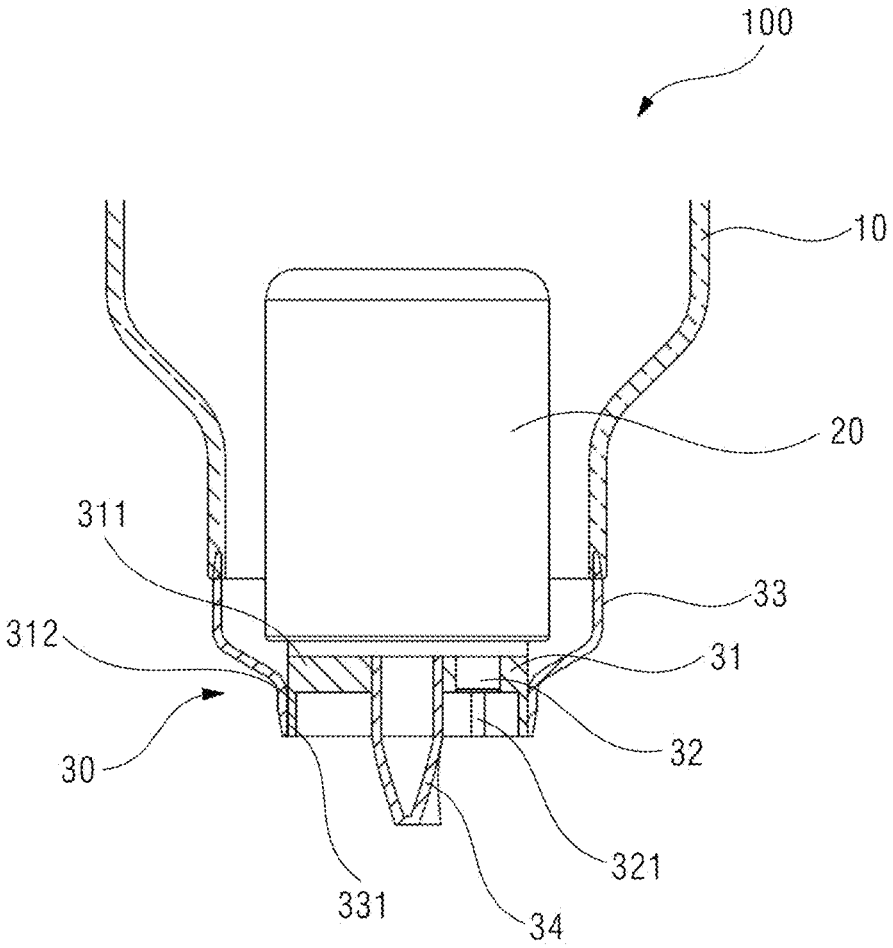
FIG. 1 shows a structural schematic drawing of an X-ray tube according to a first embodiment of the disclosure.

FIG. 1 shows a structural schematic drawing of an X-ray tube 100 according to a first embodiment of the present disclosure. The X-ray tube 100 as shown in FIG. 1 comprises a glass envelope 10 and a cathode assembly 20, wherein the cathode assembly 20 is accommodated inside the glass envelope 10. Moreover, the X-ray tube 100 further comprises a core column structure 30, wherein the core column structure 30 is connected to the glass envelope 10 and the cathode assembly 20, such that the cathode assembly 20 is sealed inside the glass envelope 10. In addition, the core column structure 30 shown in FIG. 1 comprises a metal flat plate 31 and a sealing bead 32. The cathode assembly 20 of the X-ray tube 100 is fixed or mounted on the metal flat plate 31. For example, the cathode assembly 20 is connected in a sheathing manner to the metal flat plate 31 of the core column structure 30 by screw-thread connection or welding. This manner of connection will not affect an existing manner of fitting of a cathode structure and filament, thus there is no need to adjust an original filament fitting operation. The sealing bead 32 of the core column structure 30 is arranged in the metal flat plate 31, e.g. embedded in the metal flat plate 31, and is designed such that an electrically conductive support rod 321 of electrically conductive metal wire passes through the sealing bead 32, extends out from two ends of the sealing bead 32, and is connected to a filament pin of the cathode assembly 20. Moreover, the sealing bead 32 is made of ceramic or glass, so the sealing bead 32 has good insulating properties and can also lower the cost of manufacturing the X-ray tube.

For example, the cathode assembly 20 according to this embodiment comprises a cathode head and a cathode cover, which are not shown but are generally known; a filament is supported on the cathode head and configured to generate free electrons when energized. The filament pin of the cathode assembly 20 is connected to the electrically conductive support rod 321, and thereby supplies power to the filament, not only providing a voltage difference with respect to an anode assembly (not shown), but also providing a heating current for the filament.

The X-ray tube 100 shown in FIG. 1 further comprises a metal ring 33 connected to the core column structure 30, wherein the metal flat plate 31 of the core column structure 30 is connected in a sealed manner to the glass envelope 10 of the X-ray tube 100 by means of the metal ring 33, thereby sealing the cathode assembly 20 inside the glass envelope 10. In order to connect the metal ring 33 to the glass envelope 10 in a sealed manner, for example, the glass envelope 10 is melted and thereby connected to the metal ring 33, such that the metal ring 33 is melt-connected to the glass envelope 10. The metal flat plate 31 of the core column structure 30 comprises a plate body part 311 and a tube body part 312 extending from the plate body part 311 in the axial direction of the X-ray tube 100, and the metal ring 33 has an end wall 331 connected in a sheathing manner to the tube body part 312, wherein a sealed connection to the metal flat plate 31 is achieved by Tungsten inert gas (TIG) welding of the end wall 331 of the metal ring 33 to the tube body part 312 of the metal flat plate 31.

In this embodiment, the metal ring 33 or metal flat plate 31 for instance is made of Kovar alloy or other suitable alloy (e.g. nickel-cobalt ferrous alloy). In other embodiments, the metal flat plate 31 may also be made of another metal material that has good heat conduction efficiency and can be TIG welded to Kovar (or other suitable alloy as the case may be). As shown in FIG. 1, the core column structure 30 of the X-ray tube 100 further comprises a gas discharge tube 34, the gas discharge tube 34 is arranged in the metal flat plate 31 and extends out from the metal flat plate 31; the gas discharge tube 34 is used to fully extract gas from the interior of the glass envelope 10 during manufacture of the X-ray tube 100, such that the interior of the X-ray tube 100 is a vacuum. In the embodiment shown in FIG. 1, the gas discharge tube 34 is made of any suitable metal material that has good heat conduction efficiency and is capable of performing a sealing operation, e.g. made of copper; thus, when the X-ray tube 100 is immersed in a cooling medium, the gas discharge tube 34 increases the contact area of the core column structure 30, thereby increasing the heat dissipation efficiency.

Figure 2:
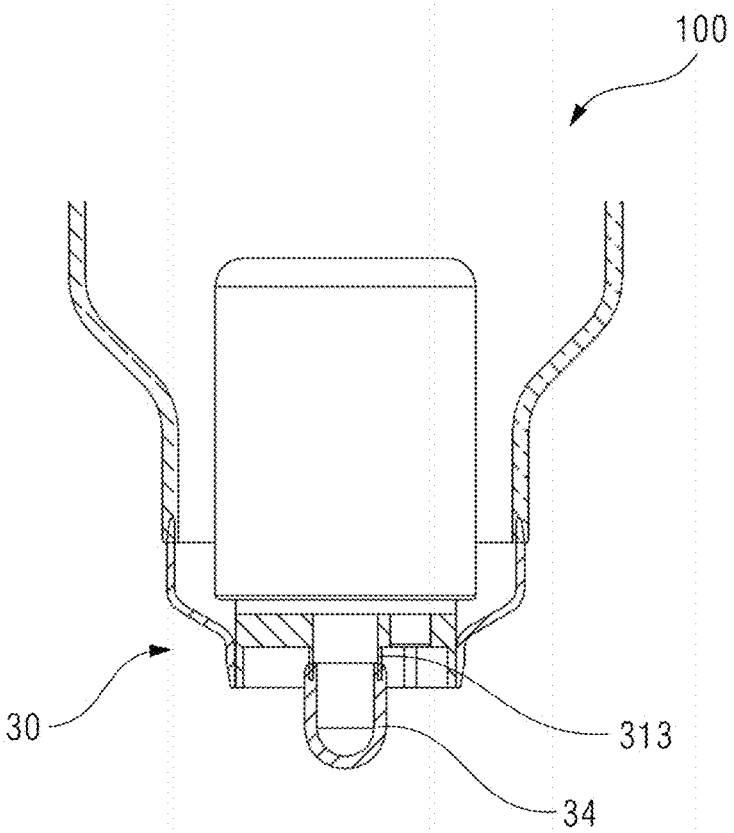
FIG. 2 shows a structural schematic drawing of an X-ray tube according to a second embodiment of the disclosure.

FIG. 2 shows a structural schematic drawing of an X-ray tube 100 according to a second embodiment of the present disclosure. Compared with the X-ray tube 100 shown in FIG. 1, the X-ray tube 100 according to the embodiment of FIG. 2 has a different gas discharge tube 34 structure. Specifically, for example, a metal flat plate 31 of a core column structure 30 of the X-ray tube 100 has a through-hole at a central part, and a gas discharge hole sidewall 313 extends out from the central part in the axial direction; a gas discharge tube 34 made of a glass material is formed on the gas discharge hole sidewall 313. For example, the glass gas discharge tube 34 is melt-connected to the sidewall extending out from the metal flat plate 31.

In the embodiments provided by the present disclosure, it should be understood that the technical content disclosed can be realized in other ways. The apparatus embodiments described above are merely schematic. For example, the division of units or modules is merely a logic function division, and other manners of division are possible in actual implementation. For example, multiple units or modules or components can be combined or integrated into another system, or some characteristics can be omitted, or not executed. In addition, any shown or discussed couplings or direct couplings may be indirect couplings, electrical, mechanical, or otherwise, via some interfaces, modules or units, or any suitable type of connection to facilitate the functionality as described herein.

The above are exemplary embodiments of the present disclosure, which are provided by way of example and not limitation. It is understood that various modifications and changes to the present disclosure are possible. Any amendments, equivalent substitutions, or improvements etc. made within the spirit and principles of the present disclosure are to be considered as part of the scope of protection thereof.

What is claimed is:

1. An X-ray tube, comprising:

a glass envelope;

a cathode assembly disposed inside the glass envelope; and a core column structure coupled to the glass envelope and to the cathode assembly such that the cathode assembly is sealed inside the glass envelope, the core column structure including:

a metal flat plate fixed to the cathode assembly;

a gas discharge tube coupled to and extending out of the metal flat plate, the gas discharge tube being configured to enable gas extraction from an interior of the glass envelope;

a sealing bead arranged in the metal flat plate; and an electrically conductive support rod coupled to the cathode assembly, the electrically conductive support rod passing through two ends of the sealing bead.

2. The X-ray tube as claimed in claim 1, further comprising:

a metal ring, wherein the metal flat plate is coupled to the glass envelope via the metal ring to form a seal.

3. The X-ray tube as claimed in claim 2, wherein the metal ring is melt-connected to the glass envelope.

4. The X-ray tube as claimed in claim 2, wherein the metal flat plate comprises a plate body part and a tube body part extending from the plate body part in an axial direction, and wherein the metal ring (i) has an end wall connected in a sheathing manner to the tube body part, and (ii) is connected to the metal flat plate via Tungsten inert gas (TIG) welding of the end wall to the tube body part to form a seal.

5. The X-ray tube as claimed in claim 2, wherein the metal ring and/or the metal flat plate is made of a nickel-cobalt ferrous alloy.

6. The X-ray tube as claimed in claim 1, wherein the cathode assembly is coupled in a sheathing manner to the metal flat plate via a screw-thread connection or via a weld.

7. The X-ray tube as claimed in claim 1, wherein the sealing bead is made of ceramic or glass.

8. The X-ray tube as claimed in claim 1, wherein the core column structure further comprises the gas discharge tube, and wherein the gas discharge tube is arranged in the metal flat plate and extends out of the metal flat plate.

9. The X-ray tube as claimed in claim 8, wherein the gas discharge tube is made of copper or glass.

10. The X-ray tube as claimed in claim 1, wherein the X-ray tube is part of an X-ray imaging device.

11. The X-ray tube as claimed in claim 1, wherein the core column structure comprises the gas discharge tube.

12. The X-ray tube as claimed in claim 11, wherein the gas discharge tube is made of copper.

13. The X-ray tube as claimed in claim 11, wherein the gas discharge tube is made of glass.

14. The X-ray tube as claimed in claim 1, wherein the metal flat plate comprises a gas discharge hole sidewall, and wherein the gas discharge tube is formed on the gas discharge hole sidewall.

15. The X-ray tube as claimed in claim 14, wherein the gas discharge tube is melt-connected to the gas discharge hole sidewall.

16. The X-ray tube as claimed in claim 1, wherein the gas discharge tube is configured to provide a heat conduction path to cooling medium in which the X-ray tube is immersed.

* * * * *